US012339083B2

(12) United States Patent
Käräjämies

(10) Patent No.: US 12,339,083 B2
(45) Date of Patent: Jun. 24, 2025

(54) FIREARM, AN UPPER RECEIVER AND A BOLT CARRIER

(71) Applicant: ENSIO FIREARMS OY, Sastamala (FI)

(72) Inventor: Toni Käräjämies, Sastamala (FI)

(73) Assignee: ENSIO FIREARMS OY, Sastamala (FI)

( * ) Notice: Subject to any disclaimer, the term of this patent is extended or adjusted under 35 U.S.C. 154(b) by 0 days.

(21) Appl. No.: 18/871,135

(22) PCT Filed: May 30, 2023

(86) PCT No.: PCT/FI2023/050302
§ 371 (c)(1),
(2) Date: Dec. 2, 2024

(87) PCT Pub. No.: WO2023/233075
PCT Pub. Date: Dec. 7, 2023

(65) Prior Publication Data

US 2025/0172359 A1 May 29, 2025

(30) Foreign Application Priority Data

May 30, 2022 (FI) ..... 20225472

(51) Int. Cl.
*F41A 3/66* (2006.01)
*F41A 3/26* (2006.01)

(52) U.S. Cl.
CPC . *F41A 3/26* (2013.01); *F41A 3/66* (2013.01)

(58) Field of Classification Search
CPC ..... F41A 3/66; F41A 3/14; F41A 3/26
See application file for complete search history.

(56) References Cited

U.S. PATENT DOCUMENTS

| | | | | |
|---|---|---|---|---|
| 9,068,793 | B1 | 6/2015 | Barrett | |
| 10,151,544 | B1 | 12/2018 | Sugg | |
| 2012/0137869 | A1 | 6/2012 | Gomez et al. | |
| 2018/0172375 | A1* | 6/2018 | Stangl | F41A 3/66 |

(Continued)

FOREIGN PATENT DOCUMENTS

WO 2008/118504 A2 10/2008

OTHER PUBLICATIONS

FI Office Action dated Jun. 10, 2024 as received in U.S. Appl. No. 20/225,472.

*Primary Examiner* — J. Woodrow Eldred
(74) *Attorney, Agent, or Firm* — Maschoff Brennan

(57) ABSTRACT

A firearm, comprises a bolt carrier group comprising a bolt carrier and a bolt, an upper receiver configured to carry the bolt carrier; a magazine well configured to receive a magazine; wherein the magazine is configured to house cartridges and comprise a spring exerting a force to the cartridges from the magazine towards the bolt carrier group; and a reverse movement of the bolt carrier group is configured to unload a used cartridge from the bolt and a forward movement of the bolt carrier group is configured to load a new cartridge from the magazine. The upper receiver comprises at least two receiver contact surfaces at a region defined by the bolt carrier group trajectory and the magazine well; a first receiver contact surface is at a first positive inclined angle against the force exerted by the spring, via the cartridge, to the bolt carrier group.

17 Claims, 4 Drawing Sheets

(56) References Cited

U.S. PATENT DOCUMENTS

| | | | | |
|---|---|---|---|---|
| 2018/0224227 | A1 | 8/2018 | Durham, III | |
| 2018/0356171 | A1 | 12/2018 | Brown | |
| 2022/0018618 | A1* | 1/2022 | Stenzel | F41C 7/00 |
| 2022/0333882 | A1* | 10/2022 | Bilgeri | F41A 15/14 |
| 2024/0361092 | A1* | 10/2024 | Noonan | F41A 3/66 |

* cited by examiner

FIREARM, AN UPPER RECEIVER AND A BOLT CARRIER

BACKGROUND

This disclosure relates generally to firearms, and more particularly to bolt carriers and upper receivers of automatic and semi-automatic firearms. Manufacturing firearms is often a trade-off between shooting precision and cost-effective serial production. Achieving improved shooting precision may require tighter manufacturing tolerances, which may be expensive to manufacture. In this context, precision describes the closeness of two or more shots to each other. It considers the spread of individual shots about the centre point of a shot group and how close individual shots are to one another, regardless of the point of impact.

The precision of the firearm is related to the repeatability of its mechanical action. The firearm's components should operate in similar manner during each loading, firing and unloading. Some high-precision firearms are manufactured with very tight tolerances that force all components to travel the same paths relative to each other. As one example, in a military use automatic or semi-automatic firearms may be susceptible of jamming due to harsh conditions or dirt around the components, if the tolerances between moving components are too tight.

AR-15 style firearms are known to suffer from carrier tilt, a phenomenon affecting a bolt carrier or a bolt carrier group. When the bolt carrier is pushed back, the rear end of the bolt carrier may tilt down due to slack and gravity. The bolt carrier may hit a buffer tube wall. As the bolt carrier moves forward, the bolt catches a cartridge from a magazine in less than optimal position. This may cause the cartridge to seat to the bolt retainer slightly off, as the bolt carrier is not perfectly aligned with the barrel extension. Many solutions have been presented to reduce the carrier tilt by providing means to reduce bolt carrier tolerances near the buffer tube.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

An automatic or semi-automatic firearm is disclosed hereinafter, as well as a bolt and a bolt carrier for the automatic or semi-automatic firearm. In one exemplary firearm type, a magazine is attached to the firearm under the bolt carrier. The magazine has a spring that pushes cartridges towards the bolt carrier, causing the bolt carrier to be pushed towards the upper receiver. Cartridges are often fed from the magazine from staggered, double-stack columns. The magazine spring's force towards the bolt carrier switches between the two columns. This causes the bolt carrier for automatic firearm to slightly move from left to right when consecutive cartridges are loaded into the bolt's cartridge retainer and pushed into a barrel extension. The spring force varies according to the number of cartridges in the magazine. The variations in the bolt carrier movement causes variations in the firearm precision.

To solve the problem, the upper receiver has two opposite inclined surfaces above the magazine that are arranged to center the bolt carrier, when the bolt carrier moves forward and the bolt catches a new cartridge from the magazine. The bolt carrier leans against the inclined surfaces during the movement. The upper receiver provides said two sliding inclined surfaces for the bolt carrier.

The centering function ensures that each time the bolt carrier moves back and forth, the consecutive movements are similar. The bolt carrier tolerances that are measured sideways or vertically do not need to be overly tight as the centering function resolves repeatability of each bolt carrier autoloading action. The centering function also mitigates the effects of carrier tilt.

The upper receiver and the bolt carrier may be upgraded to existing firearms. Thus the upgrade may be used to improve accuracy of many automatic or semiautomatic firearms. The centering function allows more economic manufacturing for the bolt carrier and the upper receiver, while improving firearm's precision. The centering function mitigates the effects of wear on the firearm action. The wear may eventually change the aim of the firearm, but the target group will stay smaller than without centering function. The changed aim may be easily corrected by adjusting sights on the firearm.

Many of the attendant features will be more readily appreciated as they become better understood by reference to the following detailed description considered in connection with the accompanying drawings. The embodiments described below are not limited to implementations which solve any or all the disadvantages of known automatic or semi-automatic firearms.

BRIEF DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. However, the same or equivalent functions and sequences may be accomplished by different examples.

Although the present examples are described and illustrated herein as being implemented in an automatic or semi-automatic rifle, they are provided as an example and not a limitation. As those skilled in the art will appreciate, the present examples are suitable for application in a variety of firearms.

Throughout the specification, references to 'front' or 'back' or 'forwards' or 'backwards' are to be interpreted in the accepted meaning in the art. For example, when the firearm is in the firing condition, a component that is generally closer to the muzzle of the barrel than another component, is construed as being forwards of the other component.

Throughout the specification, references to 'up' or 'down' or 'upwards' or 'downwards' or 'upper' or 'lower' are to be interpreted in the accepted meaning of the art. For example, when the firearm is in the firing condition and deployed on a ground plane, a component that is generally closer to the ground plane than another component, is construed as being downwards of the other component. As one example, magazine usually points down and the cartridges are upwards. It is known in the art that firearms carried by humans may be used at various orientations.

Figure 1:
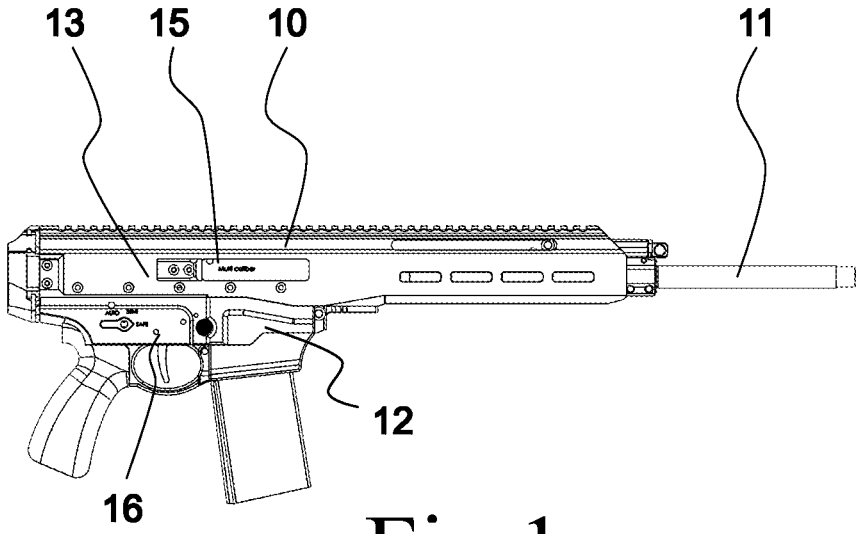
FIG. 1 illustrates schematically one exemplary embodiment of an automatic or semi-automatic firearm.

FIG. 1 illustrates schematically one exemplary embodiment of an automatic or semi-automatic firearm 10. The barrel 11 is in this embodiment interchangeable. The interchangeable barrel 11 may be selected from a group of barrels supporting at least two predetermined caliber sizes. A magazine 14 is connected to a magazine well 12. The magazine 14 is selected to house cartridges from said at least two predetermined caliber sizes. The magazine well 12 interacts with the magazine 14 by receiving and locking the magazine 14 or releasing the magazine 14. The magazine 14 may be a standard magazine, for example configured to fit either AR-15, M-16 or AK-47 type firearms. In this example, the magazine well 12 is interchangeable, thereby enabling the use of standard magazines 14.

An upper receiver 13 houses components related to the firing action, such as a bolt carrier group 20, the barrel 11 and a path to enable the reciprocating movement of the bolt carrier group 20. The upper receiver 13 is configured to carry the bolt carrier group 20. The lower receiver 16 houses the firing mechanism, magazine well 12 and the magazine 14. The upper receiver 13 and the lower receiver 16 are in some exemplary firearms integrated into one receiver, into a single body. Such examples are found in AK-47 type firearms, where the bolt carrier group 20 is configured to travel on a rail inside the receiver body, without any distinct separation to upper or lower receivers. In this context, the upper receiver 13 refers to either separate component of the firearm 10 or to the upper part of the integrated receiver.

The bolt carrier group 20 is configured to cover an ejector port 15 when the bolt carrier group 20 is in the forward position and a bolt 23 is locked into the barrel extension 30. The ejector port 15 is used to eject the used cartridge from the firearm 10. In one embodiment, the bolt carrier 21 covers the ejector port 15 in the forward position and exposes the ejector port 15 in the reverse position.

Figure 2:
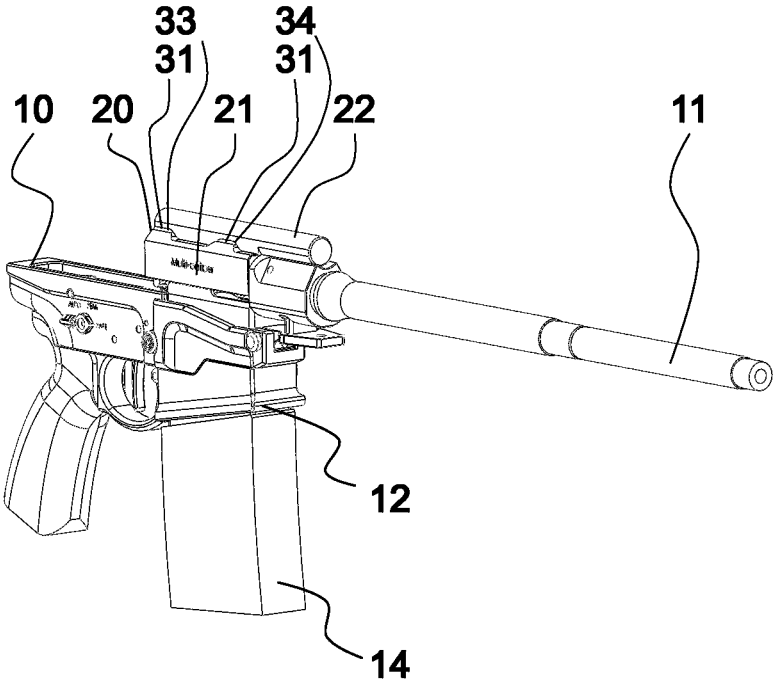
FIG. 2 illustrates schematically an isometric view from the front of the firearm without the upper receiver.
Figure 4:
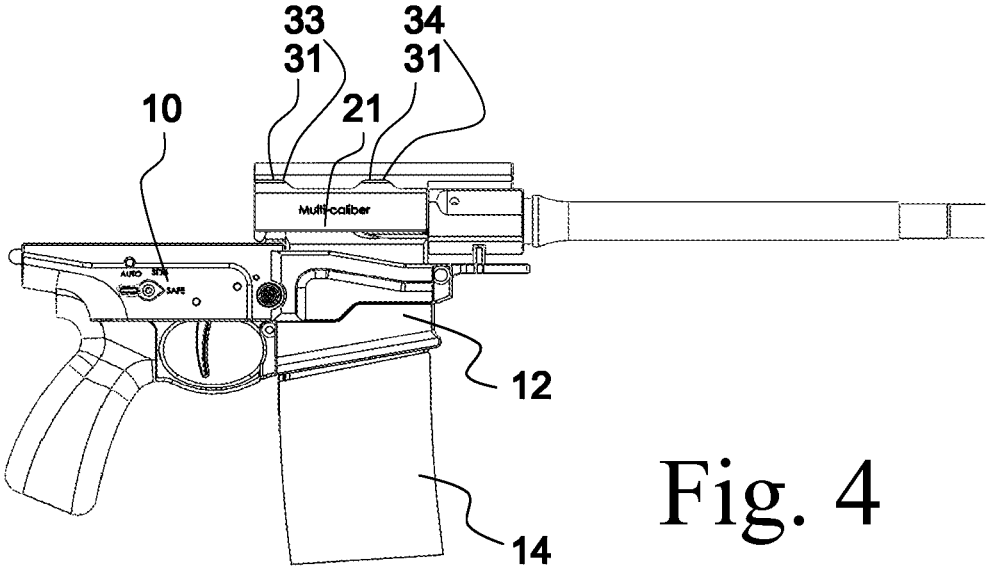
FIG. 4 illustrates schematically a side view from the backside of the firearm without the upper receiver.
Figure 5:
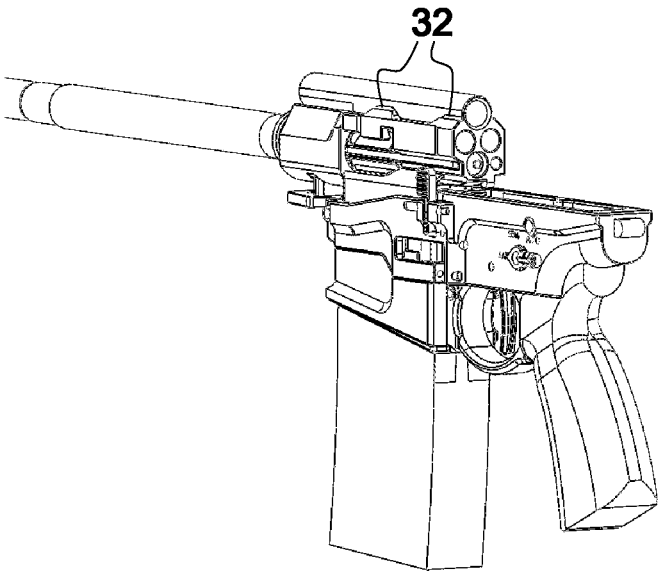
FIG. 5 illustrates schematically an isometric view from the backside of the firearm without the upper receiver.

FIG. 2 illustrates schematically an isometric view of the firearm 10 without the upper receiver 13, providing a better view of the bolt carrier group 20. FIG. 4 illustrates schematically a side view of the firearm 10 without the upper receiver 13. FIG. 5 illustrates schematically an isometric view from the backside of the firearm 10 without the upper receiver 13. The bolt carrier group 20 comprises a bolt carrier 21 and the bolt 23 inside the bolt carrier 21. The bolt carrier group 20 receives firing combustion gas via a gas key 22 that provides energy for the reverse movement of the bolt carrier group 20.

The magazine well 12 is configured to receive the magazine 14, wherein the magazine 14 is configured to house cartridges and comprise a spring exerting a force to the cartridges from the magazine 14 towards the bolt carrier group 20. In the present example the spring inside the magazine pushes the cartridges up towards the bolt carrier 21. A reverse movement of the bolt carrier group 20 is configured to unload a used cartridge from the bolt 23 and a forward movement of the bolt carrier group 20 is configured to load a new cartridge from the magazine 14.

Figure 3:
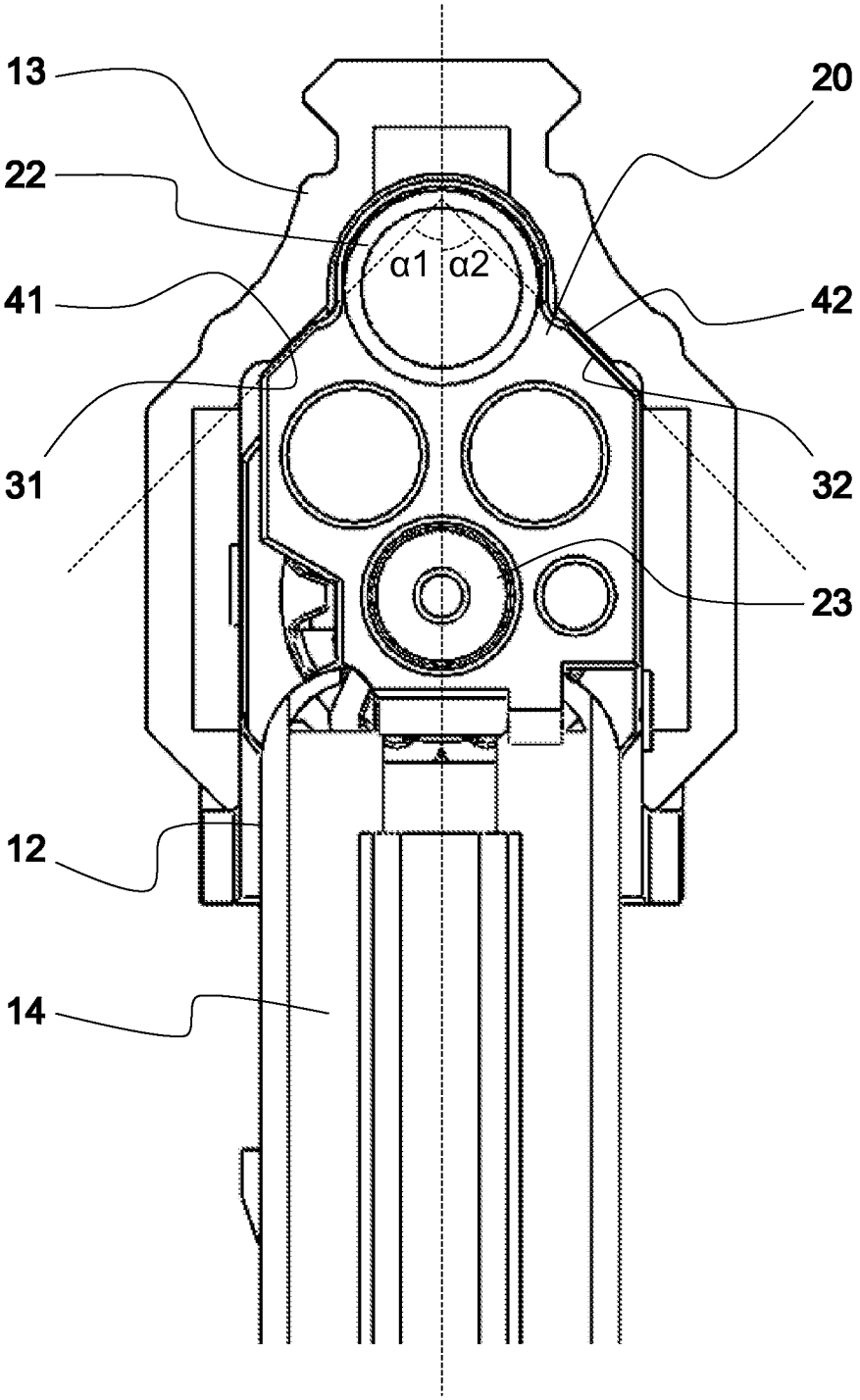
FIG. 3 illustrates schematically a cross-sectional view from the front of the firearm.

FIG. 3 illustrates schematically a cross-sectional view of the firearm from the magazine well 12 position. The upper receiver 13 comprises at least two receiver contact surfaces 41, 42 at a region defined by the bolt carrier group 20 trajectory and the magazine well 12. The bolt carrier group 20 travels on the trajectory backwards and forwards. The outer surface of the bolt carrier group 20 defines the trajectory in a space inside the upper receiver 13—defining the longitudinal portion of the region. The magazine well 12 is positioned in perpendicular to said trajectory, defining the vertical portion of the region. Said region is an intersection of the trajectory and transversely to the trajectory, extension of the magazine well 12. In one embodiment, said region is extended by 1 cm to any direction. In one embodiment, said region is extended by 2 cm to any direction.

Of the two receiver contact surfaces 41, 42, a first receiver contact surface 41 is at a first positive inclined angle $\alpha 1$ against the force exerted by the spring in the magazine 14, via the cartridge, to the bolt carrier group 20. A second receiver contact surface 42 is at a second negative inclined angle $\alpha 2$ against the force exerted by the spring, via the cartridge, to the bolt carrier group 20.

The bolt carrier group 20 comprises a first carrier contact surface 31 configured to slide against the positively inclined first receiver contact surface 41 and a second carrier contact surface 32 configured to slide against the negatively inclined second receiver contact surface 42. The first carrier contact surface 31 and the first receiver contact surface 42 provide a sliding surface. The force exerted by the spring is configured to push the bolt carrier group 20 towards the receiver contact surfaces 41, 42 and causes the bolt carrier group 20 to center between the inclined angles $\alpha 1$, $\alpha 2$. The gas key 22 does not slide against the upper receiver 13 surface, as there is provided a small gap. The sliding surfaces as described herein provide the contact upwards for the bolt carrier group 20.

In one exemplary embodiment, the first positive inclined angle $\alpha 1$ is 45 degrees measured from a line travelling perpendicular to a rotational axis of the bolt and through a middle of the magazine well. In the example of FIG. 3, said line is the vertical dashed line and the inclined dashed lines illustrate the inclined receiver contact surfaces 41,42. In one exemplary embodiment, the first positive inclined angle $\alpha 1$ is between 30 degrees and 60 degrees measured from the line travelling perpendicularly to a rotational axis of the bolt and through the middle of the magazine well; and the second negative inclined angle $\alpha 2$ is between −30 degrees and −60 degrees. In one exemplary embodiment, the first positive inclined angle $\alpha 1$ is between 40 degrees and 50 degrees measured from the line travelling perpendicularly to the rotational axis of the bolt and through the middle of the magazine well; and the second negative inclined angle is between −40 degrees and −50 degrees.

In one embodiment, the first receiver contact surface 41 and the second receiver contact surface 42 comprise the same material as the upper receiver. In one embodiment, the first receiver contact surface 41 and the second receiver contact surface 42 comprise a replaceable receiver wear surface. In one embodiment, the replaceable receiver wear surface is made of metal. In one embodiment, the replaceable receiver wear surface is made of polyoxymethylene. In one embodiment, the replaceable receiver wear surface is made of nylon. In one embodiment, the replaceable receiver wear surface is attached to the upper receiver 13 by a fastener, such as a bolt. In one embodiment, the replaceable receiver wear surface is attached to the upper receiver 13 by an adhesive, that may be removed by applying heat to the adhesive.

In one embodiment, the first carrier contact surface 31 and the second carrier contact surface 32 comprise a replaceable carrier wear surface. In one embodiment, the replaceable carrier wear surface is made of metal. In one embodiment, the replaceable carrier wear surface is made of polyoxymethylene. In one embodiment, the replaceable carrier wear surface is made of nylon. In one embodiment, the replaceable carrier wear surface is attached to the upper receiver 13 by a fastener, such as a bolt. In one embodiment, the replaceable carrier wear surface is attached to the upper receiver 13 by an adhesive, that may be removed by applying heat to the adhesive.

In one embodiment, the bolt carrier 21 comprises a carrier contact extension above the rotational axis of the bolt 23, where the magazine well 12 is below the rotational axis of the bolt 23; and the carrier contact extension comprises the first carrier contact surface 33 and the second carrier contact surface 34. This embodiment is illustrated in FIGS. 2-5, where the carrier contact surface 31 has a slot in the middle, dividing the carrier contact surface into two surfaces 33, 34. This arrangement reduces the sliding surface area and in some circumstances, reduces the overall friction between the upper receiver 13 and the bolt carrier 21. In one embodiment, the carrier contact extension comprises multiple first carrier contact surfaces 33 and multiple second carrier contact surfaces 34. The carrier contact surface 31 may arranged into multiple portions.

Figure 6:
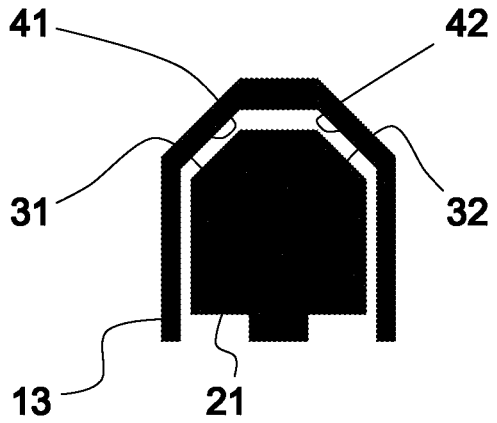
FIG. 6 illustrates schematically a cross-sectional view of the bolt carrier and the upper receiver.

In various embodiment, the sliding surfaces are arranged into different positions and shapes, while maintaining the centering function. FIG. 6 illustrates schematically a cross-sectional view of the bolt carrier 21 and the upper receiver 13 with the inclined sliding surfaces 31-42 and 32-42 as illustrated in FIGS. 2-5.

Figure 7:
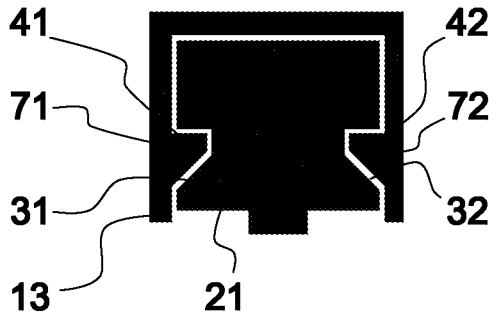
FIG. 7 illustrates schematically a cross-sectional view of another embodiment of the bolt carrier and the upper receiver.
Figure 8:
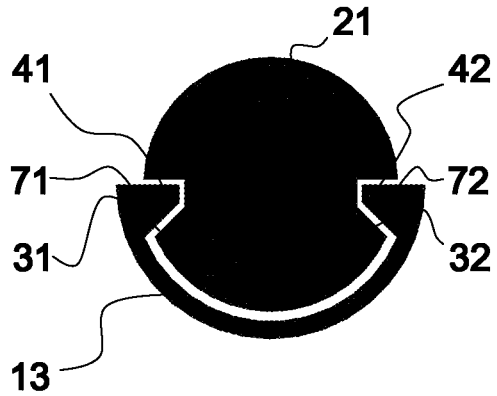
FIG. 8 illustrates schematically a cross-sectional view of another embodiment of the bolt carrier and the upper receiver.

FIG. 7 and FIG. 8 illustrate alternative arrangements for the centering function, applying rails 71, 72 at a lower position in the upper receiver 13. In one embodiment, the bolt carrier 21 comprises a carrier contact extension below the rotational axis of the bolt 23, where the magazine well 12 is below the rotational axis of the bolt 23; and the first receiver contact extension comprises a first rail 71 below the rotational axis of the bolt 23 and the second receiver contact extension comprises a second rail 72 below the rotational axis of the bolt 23.

A firearm is disclosed herein, comprising: a bolt carrier group comprising a bolt carrier and a bolt, an upper receiver configured to carry the bolt carrier; a magazine well configured to receive a magazine; wherein the magazine is configured to house cartridges and comprise a spring exerting a force to the cartridges from the magazine towards the bolt carrier group; and a reverse movement of the bolt carrier group is configured to unload a used cartridge from the bolt and a forward movement of the bolt carrier group is configured to load a new cartridge from the magazine. The upper receiver comprises at least two receiver contact surfaces at a region defined by the bolt carrier group trajectory and the magazine well; a first receiver contact surface is at a first positive inclined angle against the force exerted by the spring, via the cartridge, to the bolt carrier group; a second receiver contact surface is at a second negative inclined angle against the force exerted by the spring, via the cartridge, to the bolt carrier group; the bolt carrier group comprises a first carrier contact surface configured to slide against the positively inclined first receiver contact surface and a second carrier contact surface configured to slide against the negatively inclined second receiver contact surface; wherein the force exerted by the spring is configured to push the bolt carrier group towards the at least two receiver contact surfaces and causes the bolt carrier group to center between the inclined angles defined by the first receiver contact surface and the second receiver contact surface. In one embodiment, the first positive inclined angle is between 30 degrees and 60 degrees measured from a line travelling perpendicularly to a rotational axis of the bolt and through a middle of the magazine well; and the second negative inclined angle is between −30 degrees and −60 degrees. In one embodiment, the first positive inclined angle is between 40 degrees and 50 degrees measured from a line travelling perpendicularly to a rotational axis of the bolt and through a middle of the magazine well; and the second negative inclined angle is between −40 degrees and −50 degrees. In one embodiment, the first receiver contact surface and the second receiver contact surface comprise a replaceable receiver wear surface. In one embodiment, the first carrier contact surface and the second carrier contact surface comprise a replaceable carrier wear surface. In one embodiment, the bolt carrier comprises a carrier contact extension above the rotational axis of the bolt, where the magazine well is below the rotational axis of the bolt; and the carrier contact extension comprises the first carrier contact surface and the second carrier contact surface. In one embodiment, the carrier contact extension comprises multiple first carrier contact surfaces and multiple second carrier contact surfaces. In one embodiment, the bolt carrier comprises a carrier contact extension below the rotational axis of the bolt, where the magazine well is below the rotational axis of the bolt; and the first receiver contact extension comprises a first rail below the rotational axis of the bolt and the second receiver contact extension comprises a second rail below the rotational axis of the bolt.

Alternatively, or in addition, an upper receiver for a firearm is disclosed herein. The upper receiver is configured to interact with a bolt carrier; wherein the firearm comprises a bolt carrier group comprising the bolt carrier and a bolt, a magazine well configured to receive a magazine; wherein the magazine is configured to house cartridges and comprise a spring exerting a force to the cartridges from the magazine towards the bolt carrier group; and a reverse movement of the bolt carrier group is configured to unload a used cartridge from the bolt and a forward movement of the bolt carrier group is configured to load a new cartridge from the magazine. The upper receiver comprises at least two receiver contact surfaces at a region defined by the bolt carrier group trajectory and the magazine well; a first receiver contact surface is at a first positive inclined angle against the force exerted by the spring, via the cartridge, to the bolt carrier group; a second receiver contact surface is at a second negative inclined angle against the force exerted by the spring, via the cartridge, to the bolt carrier group. In one embodiment, the first positive inclined angle is between 40 degrees and 50 degrees measured from a line travelling perpendicularly to a rotational axis of the bolt and through a middle of the magazine well; and the second negative inclined angle is between −40 degrees and −50 degrees. In one embodiment, the first receiver contact surface and the second receiver contact surface comprise a replaceable receiver wear surface. In one embodiment, the first receiver contact extension comprises a first rail below the rotational axis of the bolt and the second receiver contact extension comprises a second rail below the rotational axis of the bolt, where the magazine well is below the rotational axis of the bolt.

Alternatively, or in addition, a bolt carrier for a firearm is disclosed herein. The bolt carrier is configured to interact with an upper receiver, where the firearm comprises: a bolt carrier group comprising the bolt carrier and a bolt, the upper receiver configured to carry the bolt carrier; a magazine well configured to receive a magazine; wherein the magazine is configured to house cartridges and comprise a spring exerting a force to the cartridges from the magazine towards the bolt carrier group; and a reverse movement of the bolt carrier group is configured to unload a used cartridge from the bolt and a forward movement of the bolt carrier group is configured to load a new cartridge from the magazine. The bolt carrier comprises a first carrier contact surface configured to slide against a positively inclined first receiver contact surface and a second carrier contact surface configured to slide against a negatively inclined second receiver contact surface; wherein the force exerted by the spring is configured to push the bolt carrier group towards the at least two receiver contact surfaces and cause the bolt carrier group to center between the inclined angles defined by the first receiver contact surface and the second receiver contact surface. In one embodiment, the first carrier contact surface and the second carrier contact surface comprise a replaceable carrier wear surface. In one embodiment, the bolt carrier comprises a carrier contact extension above the rotational axis of the bolt, where the magazine well is below the rotational axis of the bolt; and the carrier contact extension comprises the first carrier contact surface and the second carrier contact surface. In one embodiment, the carrier contact extension comprises multiple first carrier contact surfaces and multiple second carrier contact surfaces. In one embodiment, the bolt carrier comprises a carrier contact extension below the rotational axis of the bolt, where the magazine well is below the rotational axis of the bolt; and the carrier contact extension is configured to interact with a first receiver contact extension comprising a first rail below the rotational axis of the bolt and the second receiver contact extension comprises a second rail below the rotational axis of the bolt.

Any range or device value given herein may be extended or altered without losing the effect sought.

Although at least a portion of the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A firearm, comprising:

a bolt carrier group comprising a bolt carrier and a bolt, an upper receiver configured to carry the bolt carrier;

a magazine well configured to receive a magazine;

wherein the magazine is configured to house cartridges and comprise a spring exerting a force to the cartridges from the magazine towards the bolt carrier group; and a reverse movement of the bolt carrier group is configured to unload a used cartridge from the bolt and a forward movement of the bolt carrier group is configured to load a new cartridge from the magazine; and wherein the upper receiver comprises at least two receiver contact surfaces at a region defined by the bolt carrier group trajectory and the magazine well;

a first receiver contact surface is at a first positive inclined angle against the force exerted by the spring, via the cartridge, to the bolt carrier group;

a second receiver contact surface is at a second negative inclined angle against the force exerted by the spring, via the cartridge, to the bolt carrier group;

the bolt carrier group comprises a first carrier contact surface configured to slide against the positively inclined first receiver contact surface and a second carrier contact surface configured to slide against the negatively inclined second receiver contact surface;

wherein the force exerted by the spring is configured to push the bolt carrier group towards the at least two receiver contact surfaces and causes the bolt carrier group to center between the inclined angles defined by the first receiver contact surface and the second receiver contact surface.

2. A firearm according to claim 1, wherein the first positive inclined angle is between 30 degrees and 60 degrees measured from a line travelling perpendicularly to a rotational axis of the bolt and through a middle of the magazine well; and the second negative inclined angle is between −30 degrees and −60 degrees.

3. A firearm according to claim 1, wherein the first positive inclined angle is between 40 degrees and 50 degrees measured from a line travelling perpendicularly to a rotational axis of the bolt and through a middle of the magazine well; and the second negative inclined angle is between −40 degrees and −50 degrees.

4. A firearm according to claim 1, wherein the first receiver contact surface and the second receiver contact surface comprise a replaceable receiver wear surface.

5. A firearm according to claim 1, wherein the first carrier contact surface and the second carrier contact surface comprise a replaceable carrier wear surface.

6. A firearm according to claim 1, wherein the bolt carrier comprises a carrier contact extension above the rotational axis of the bolt, where the magazine well is below the rotational axis of the bolt; and the carrier contact extension comprises the first carrier contact surface and the second carrier contact surface.

7. A firearm according to claim 6, wherein the carrier contact extension comprises multiple first carrier contact surfaces and multiple second carrier contact surfaces.

8. A firearm according to claim 1, wherein the bolt carrier comprises a carrier contact extension below the rotational axis of the bolt, where the magazine well is below the rotational axis of the bolt; and the first receiver contact extension comprises a first rail below the rotational axis of the bolt and the second receiver contact extension comprises a second rail below the rotational axis of the bolt.

9. An upper receiver for a firearm, configured to interact with a bolt carrier;

wherein the firearm comprises a bolt carrier group comprising the bolt carrier and a bolt, a magazine well configured to receive a magazine;

wherein the magazine is configured to house cartridges and comprise a spring exerting a force to the cartridges from the magazine towards the bolt carrier group; and a reverse movement of the bolt carrier group is configured to unload a used cartridge from the bolt and a forward movement of the bolt carrier group is configured to load a new cartridge from the magazine; and wherein the upper receiver comprises at least two receiver contact surfaces at a region defined by the bolt carrier group trajectory and the magazine well;

a first receiver contact surface is at a first positive inclined angle against the force exerted by the spring, via the cartridge, to the bolt carrier group;

a second receiver contact surface is at a second negative inclined angle against the force exerted by the spring, via the cartridge, to the bolt carrier group.

10. An upper receiver according to claim 9, wherein the first positive inclined angle is between 30 degrees and 60 degrees measured from a line travelling perpendicularly to a rotational axis of the bolt and through a middle of the magazine well; and the second negative inclined angle is between 30 degrees and 60 degrees.

11. An upper receiver according to claim 9, wherein the first receiver contact surface and the second receiver contact surface comprise a replaceable receiver wear surface.

12. An upper receiver according to claim 9, wherein the first receiver contact extension comprises a first rail below the rotational axis of the bolt and the second receiver contact extension comprises a second rail below the rotational axis of the bolt, where the magazine well is below the rotational axis of the bolt.

13. A bolt carrier for a firearm, configured to interact with an upper receiver, where the firearm comprises:

a bolt carrier group comprising the bolt carrier and a bolt, the upper receiver configured to carry the bolt carrier;

a magazine well configured to receive a magazine;

wherein the magazine is configured to house cartridges and comprise a spring exerting a force to the cartridges from the magazine towards the bolt carrier group; and a reverse movement of the bolt carrier group is configured to unload a used cartridge from the bolt and a forward movement of the bolt carrier group is configured to load a new cartridge from the magazine; and wherein the bolt carrier comprises a first carrier contact surface configured to slide against a positively inclined first receiver contact surface and a second carrier contact surface configured to slide against a negatively inclined second receiver contact surface;

wherein the force exerted by the spring is configured to push the bolt carrier group towards the at least two receiver contact surfaces and cause the bolt carrier group to center between the inclined angles defined by the first receiver contact surface and the second receiver contact surface.

14. A bolt carrier according to claim 13, wherein the first carrier contact surface and the second carrier contact surface comprise a replaceable carrier wear surface.

15. A bolt carrier according to claim 13, wherein the bolt carrier comprises a carrier contact extension above the rotational axis of the bolt, where the magazine well is below the rotational axis of the bolt; and the carrier contact extension comprises the first carrier contact surface and the second carrier contact surface.

16. A bolt carrier according to claim 15, wherein the carrier contact extension comprises multiple first carrier contact surfaces and multiple second carrier contact surfaces.

17. A bolt carrier according to claim 13, wherein the bolt carrier comprises a carrier contact extension below the rotational axis of the bolt, where the magazine well is below the rotational axis of the bolt; and the carrier contact extension is configured to interact with a first receiver contact extension comprising a first rail below the rotational axis of the bolt and the second receiver contact extension comprises a second rail below the rotational axis of the bolt.

* * * * *